United States Patent [19]

Griessbaum

[11] 4,381,804

[45] May 3, 1983

[54] WOVEN SLIDE-FASTENER STRINGER

[75] Inventor: Karl Griessbaum, Essen, Fed. Rep. of Germany

[73] Assignee: Opti Patent-, Forschungs- und Fabrikations-AG, Riedern-Allmeind, Switzerland

[21] Appl. No.: 237,672

[22] Filed: Feb. 24, 1981

[30] Foreign Application Priority Data

Feb. 27, 1980 [DE] Fed. Rep. of Germany ..... 3007276

[51] Int. Cl.[3] ..... D03D 1/00; A44B 19/34

[52] U.S. Cl. ..... 139/384 B; 24/205.16 C

[58] Field of Search ..... 139/384 B, 384 R, 116; 24/205.1 C, 205.13 C, 205.16 C

[56] References Cited

U.S. PATENT DOCUMENTS

| | | | |
|---|---|---|---|
| 3,847,188 | 11/1974 | Auer et al. | 139/384 B |
| 4,140,157 | 2/1979 | Scott | 139/384 B |
| 4,215,729 | 8/1980 | Ofusa | 139/384 B |
| 4,334,556 | 6/1982 | Fröhlich et al. | 139/384 B |

*Primary Examiner*—James Kee Chi

*Attorney, Agent, or Firm*—Karl F. Ross; Herbert Dubno

[57] ABSTRACT

A slide-fastener stringer has a tape formed from a ground weave with double wefts interwoven with a warp and a coupling element disposed along the edge of the tape and held thereto by binding warps. The coupling element is of the type in which a synthetic resin monofilament is coiled to form coupling heads whose shanks are disposed one above the other so that they have a common projection in the slide fastener plane. The shanks are connected to those of successive heads by bights. The coupling warp comprises a plurality of warp yarns whose patterns are offset lengthwise by at least one pick and which each passes over two coupling elements, between the next coupling element and a ground double weft and under a double weft between coupling elements in a repeating pattern. Double weft disposed between consecutive coupling members are drawn upwardly beyond the median plane of the coupling element as ground-weft padding loops.

8 Claims, 10 Drawing Figures

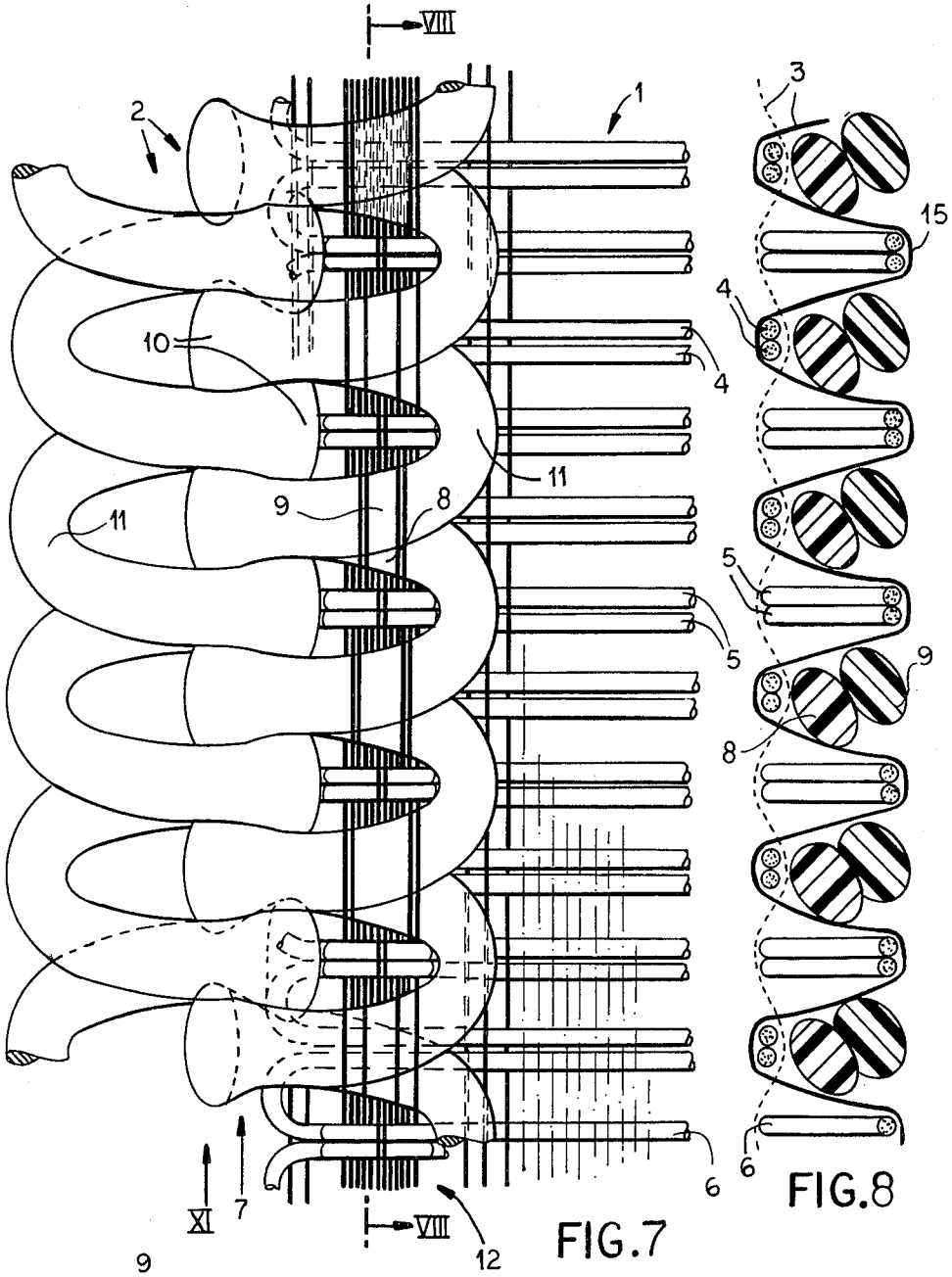
FIG.7
FIG.8
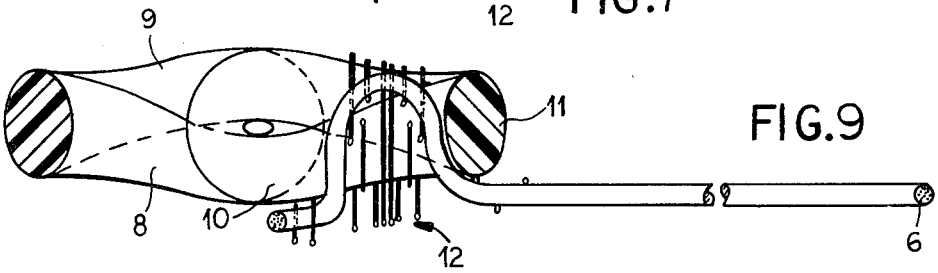
FIG.9

WOVEN SLIDE-FASTENER STRINGER

CROSS-REFERENCE TO RELATED APPLICATION

This application is related to our commonly assigned copending application Ser. No. 195,000, filed Oct. 9, 1980 and entitled WOVEN SLIDE-FASTENER STRINGER.

FIELD OF THE INVENTION

Our present invention relates to a slide fastener of the woven-tape type and, more particularly, to slide fasteners with woven stringer tapes with continuous coupling elements mounted along edges thereof and fixed in the weave.

BACKGROUND OF THE INVENTION

A slide fastener generally comprises a pair of stringer tapes along confronting edges of which are mounted rows of coupling heads or teeth which interdigitate upon movement of a slider along these rows. The tapes and the rows of coupling heads form stringers and the slide fastener may be provided at its ends with stop members preventing withdrawal of a slider, means for coupling the two tapes or slide-fastener halves together in the case of a nonseparable slide fastener, or male and female formations enabling the coupling and decoupling of the stringer halves in the case of a separable slide fastener.

The tapes generally are incorporated, e.g. by stitching, in opposite sides of an article having an opening which can be closed by the slide fastener.

The slide-fastener art has advanced rapidly in recent years both with respect to techniques for the fabrication of the stringers and with respect to improvements in the mechanical and esthetic properties thereof. For example, woven support tapes which have hitherto been provided with the coupling heads by clamping, by molding or by rows of stitching, have increasingly been provided with the heads directly during the tape-weaving operation utilizing conventional tape looms which can be modified to allow the coupling heads to be mounted on the edges of the tape as the tape is woven.

In recent years, moreover, individually mounted coupling heads have tended to be replaced by continuous coupling elements composed of a synthetic resin monofilament and of coil or meander configuration. The individual coupling heads can be formed by deforming, e.g. molding, bending or kinking the monofilament at spaced-apart locations, to so shape the head that it has lateral protrusions which can engage behind the heads of the opposing coupling element when the two are interdigitated, i.e. when the heads of one coupling element are fitted into the interstices or interhead spaces of the opposing coupling element.

The heads have shanks which reach toward the respective tapes and can be connected to the shanks of adjoining heads by connecting members or bights. Each head and the associated pair of shanks will be referred to hereinafter as a coupling member and because coils of the type described have a generally dentate configuration, the coupling heads or coupling members may be referred to as "teeth". In referring to woven support tapes, reference will be made to the ground weave. This, of course, is intended to mean the woven fabric consisting of weft yarns and warp yarns, to which the coupling element is secured. A ground weft is, therefore, a weft yarn structure of the ground weave. A "double weft" is a weft of a single yarn having two passes received in the same warp pockets or shed in traversing the tape.

It is known, e.g. from German open application (Offenlengungsschrift) DE-OS No. 2 219 907 and the corresponding U.S. Pat. No. 3,880,203 issued Apr. 29, 1975 to Alfons Fröhlich, one of the present joint inventors, to provide stringer tapes which are composed of warp yarns and double wefts formed from a continuous ground weft yarn with the coupling element being woven into the tape or secured to the tape by weaving. In this case, the two shanks of each coupling member can also form a double weft which is secured to the ground weave by warp yarns at least in part.

The teeth or coupling members have their shanks superposed, i.e. an upper shank lies directly over a lower shank so that the two shanks of each coupling member and connected to a respective coupling head, have a common projection in the slide fastener plane. In this construction, moreover, double wefts of the ground weft yarns are disposed between the coupling members. These double ground wefts can be received in their own warp yarn pockets, i.e. the pockets in the warp resulting from shedding the warp during weaving and defined as the pockets between consecutive crossings of the warp in warp patterning.

While the stringer of these publications has been found to be excellent for most purposes, it is susceptible to damage by a sharp transverse pull upon the coupling elements toward the coupling head side and away from the tape. Furthermore, the afore-mentioned weaving attachment does not always provide satisfactory flexibility of the fastener.

It has been found also that longitudinal tension or stress upon the stringer tape, or shrinkage of the latter, has a tendency to vary the spacing or pitch between the teeth because the spacing between two shanks of different coupling members received in a common warp pocket responds to deformation thereof.

Finally, while the tapes with the coupling elements woven into place can be fabricated on conventional double-pick needle tape looms, the particular system of securing the coupling elements has been found to limit the speed at which the loom can operate.

Slide fasteners which are improvements over those of the above-mentioned publication are described in our copending application Ser. No. 195,000, filed Oct. 9, 1980 in which each connecting warp yarn is offset from the next by two weft picks, each such yarn engaging alternately in a repeating pattern above a pair of coupling members and above the next coupling member, then below the subsequent coupling member. Between the pair of coupling members and the following coupling member overshot by the connecting warp yarn, the lock engages below an interstitial ground weft yarn forming a double weft disposed between the pair of coupling members and the next coupling member.

The connecting warp yarns also can engage over the double weft of the ground weft yarn disposed between the individual overshot coupling member and the next undershot coupling member.

In a slide fastener of this type the double warps of the ground weft yarn and the monofilament double weft are disposed in separate warp pockets disposed one above another transverse to the fastener plane.

The result is a particularly soft and flexible slide fastener since the weft joints of the stringer tapes and the stringer tape as a whole can move above the rows of coupling members in response to bending stresses in the fastener plane and in response to kinking forces applied to the slide fastener. Another advantage is that the pitch (interhead spacing) of the slide fastener remains very stable and does not materially alter as subjected to dyeing, washing or ironing.

However, slide fastener of the type described in our copending application do not always fully satisfy all requirement with regard to antikinking properties. The term "kinking" is here used to refer to a distortion of the slide fastener in response to sharp bends up or down of the stringer from the fastener plane. The antikinking property of kink resistance is a measure of the transverse tensile strength in response to the up or down bending movements from the fastener plane. This property increases substantially parabolically with radius of curvature near the kinking point or vertex, i.e. the smaller the kinking angle, the worse is the ability of the stringer to withstand the kinking.

OBJECTS OF THE INVENTION

It is an object of the present invention to provide a slide fastener stringer which improves upon the principles set forth in our abovementioned copending application.

Another object of the present invention is to provide a slide-fastener stringer having improved flexibility and a high degree of mechanical stability, especially pitch stability, against stresses of all type and in all directions, and which can be fabricated on modern automatic needle looms at high speed.

Yet another object of the invention is to provide a slide fastener stringer with improved attachment of the coupling element to the support tapes.

Still another and highly important object of the invention is to improve the kink resistance and anti-kinking properties of a slide-fastener stringer of the type described.

SUMMARY OF THE INVENTION

These objects and others which will become apparent hereinafter are attained, in accordance with the present invention, in the woven slide-fastener stringer which comprises a ground weft having double wefts with a continuous weft yarn interwoven with the ground warp and lying in warp pockets thereof, and the coupling element along the respective edge of the ground weft having a plurality of spaced-apart coupling members of synthetic resin monofilament with superposed shanks such that, at least generally, the shanks of each member have a common projection or superimposed projections) in the slide-fastener plane and form a double weft which is secured to the tape by connective or securing warp yarns.

According to the invention, ground double wefts are positioned below the superposed shanks of each coupling member and between the coupling members, the double weft between the coupling members being referred to as an interstitial double weft.

According to the present invention, the connective warp yarns each engage over two coupling members (i.e overshooting a pair of coupling members), passing below the double weft of the ground weft yarn therebetween, i.e. beneath the interstitial weft between these coupling members. The connecting yarn, within the same repeating pattern, then passes beneath the next coupling member between the bottom shank thereof and the double weft underlying same, with the connective warp yarn being then secured in the stringer tape zone or portion below the teeth, e.g. by passing under or over the double wefts of the ground weft.

According to an essential feature of the invention, the interstitial double wefts are drawn by at least one of the connective warp yarns away from the ground weft, i.e. upwardly toward the level of the top shanks on the coupling members and at least beyond the median plane of the coupling element to form a ground weft padding loop between each pair of coupling members. Advantageously, this ground weft padding loop lies flush with the level of the top shanks of the coupling members or projects thereabove.

We have found, most surprisingly, that the kink resistance or a slide fastener of the generaly type described in the afore-mentioned U.S. patent can be markedly improved by providing such support pads which are disposed between the upper shanks of the adjacent or successive coupling members. These support pads appear to reduce the curvature upon a tendency of the stringer to kink and thus prevent the radius of the bend from being so small that kinking can occur. As a consequence, the kink resistance of the slide fastener stringer of the present invention is markedly improved.

According to a feature of the invention, the double wefts of the ground weft yarn disposed between the coupling members, i.e. the interstitial double wefts, are drawn up by more than one of the connective warp yarns which relative to one another are offset longitudinally by at least one pick as to the respective warp patterns.

It has also been found to be advantageous to draw up at least one of the ground warp yarns between adjacent coupling members to form a ground warp padding loop which can lie above or at the level of the upper shanks of the coupling members.

While the securing warp yarn can be fixed to the ground weave in any desired manner we have found that certain patterns are preferable. For example, in one preferred case, the connective warp yarns engage, where they are secured to the stringer tape zone below the coupling members, below two double wefts, the warp yarn then passing below one of these double wefts in the interstitial region between coupling members and below another double weft which is provided beneath a coupling member.

In another embodiment which has also proved to be satisfactory, the connective weft yarns engage, where they are secured to the stringer tape zone below the coupling members, beneath a double weft between adjacent teeth (i.e. beneath an interstitial double weft), then extending between the bottom shank of the next coupling member and the double weft therebelow to engage over the next two coupling members in the overshoot mentioned previously to repeat the pattern.

If with the coupling members interlocked, the ground weft padding loops and/or the ground warp padding loops completely fill the space between the adjacent top shanks of the coupling members and a coupling head of the other coupling element received therebetween, the risk of fastener opening by accidental stress is significantly reduced.

Furthermore, the kink resistance is further improved because the padding loops and cooperating interlocked coupling head are pressed against each other and the coupling members between which the head is fitted so as to preload or pack the interstices.

BRIEF DESCRIPTION OF THE DRAWING

The above and other objects, features and advantages of the present invention will become more readily apparent from the following description, reference being made to the accompanying drawing in which:

FIG. 7 is a plan view of a system in which, like in FIG. 6, a ground warp yarn forms a padding yarn in the manner described;

FIG. 8 is a cross sectional view taken along the line VIII—VIII of FIG. 7;

FIG. 9 is a view in cross section in the direction of the arrow IX of FIG. 7.

SPECIFIC DESCRIPTION

Figure 1:
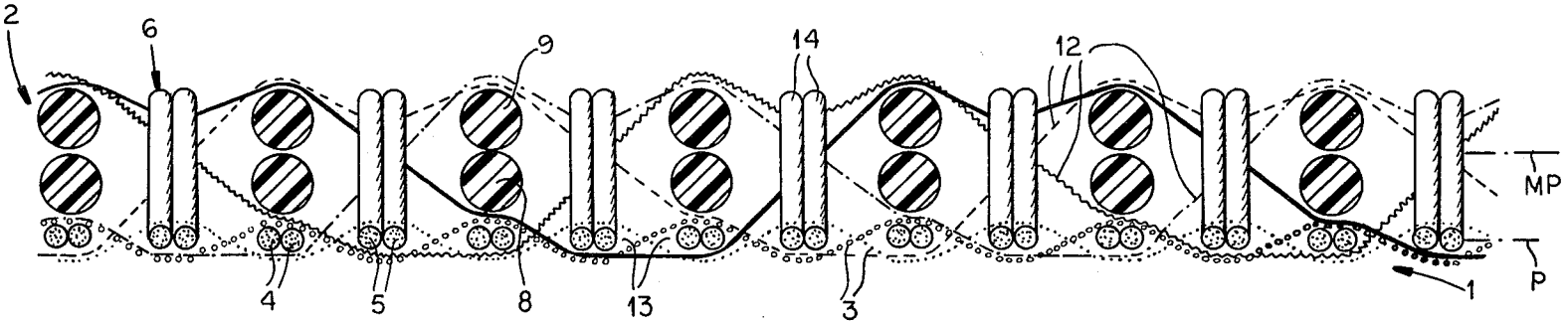
FIG. 1 is a diagrammatic cross-sectional view illustrating in greatly enlarged scale the weft and warp patterns in accordance with the invention and the showing their relationship with the shanks of the coupling members which have been shown in section as well.

As can be seen from FIGS. 1 through 4, a slide fastener stringer can have a pair of woven stringer tapes 1, only one of which has been illustrated although the coupling element of the nonillustrated stringer tape is shown to be interdigitated with the coupling element of the stringer tape which has been shown in some detail.

Woven into and onto the stringer tape 1 is a coupling element 2 which is of the helical coil synthetic resin monofilament type.

The stringer tape 1 is formed by ground warp yarns 3 and double wefts 4, 5 of the continuous ground weft yarn 6. The wefts 4 are disposed beneath coupling members having shanks 8 and 9 while the wefts 5 are termed interstitial wefts and are disposed between the coupling members.

Each coupling element 2 is composed of a multiplicity of coupling members 7 having heads 10 connected by rearwardly extending shanks 8 and 9 to bights or connective parts 11 which join the shanks of adjacent coupling members together.

The shanks 8 are referred to as bottom shanks while the shanks 9 are top shanks, i.e. the shanks disposed more remotely from the ground weave.

The shanks are disposed substantially one above another so that they generally have a common projection on the slide fastener plane, i.e. the plane P in FIG. 1. The median plane of the coupling element 2 is represented at MP in FIG. 1 as well.

In an edge zone of the stringer tape represented at 50 securing warp yarns 12 engaged over the coupling members 7 to secure the same to the tape 1. The double wefts lie in their own ground warp yarn pockets 13 in this zone of the stringer tape below the coupling members.

Figure 6:
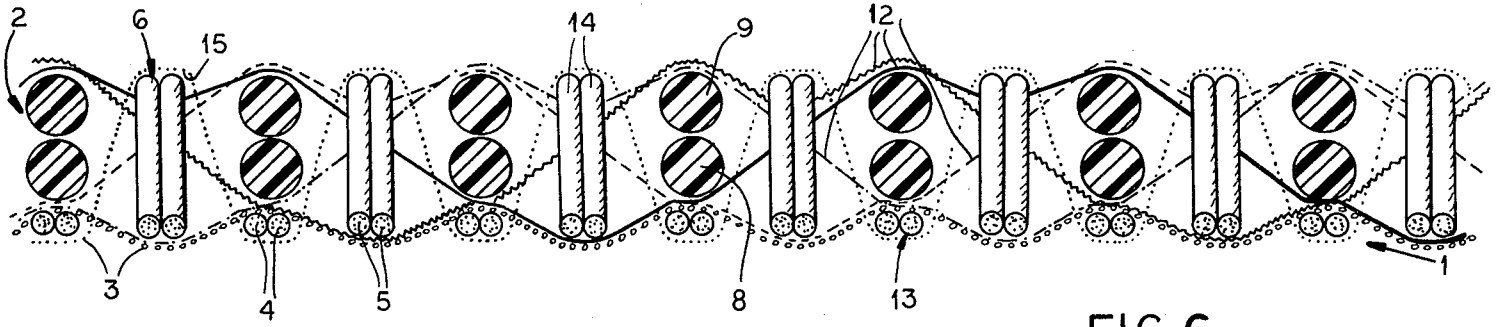
FIG. 6 is a view similar to FIG. 1 showing another patterning of the connective warp yarns.
Figure 2:
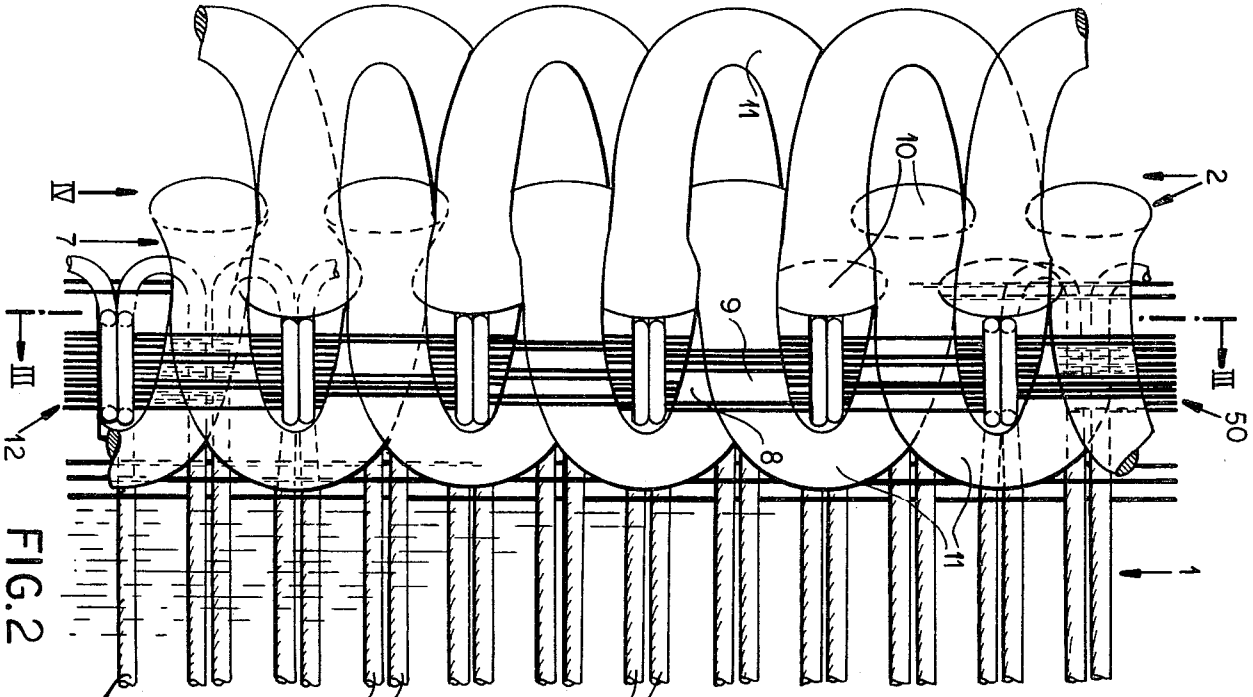
FIG. 2 is a plan view of a slide fastener using the pattern of FIG. 1.
Figure 3:
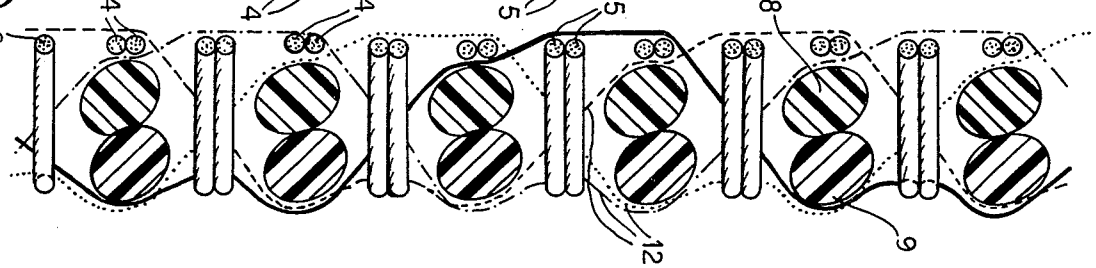
FIG. 3 is a section taken along the line III—III of FIG. 2.
Figure 4:
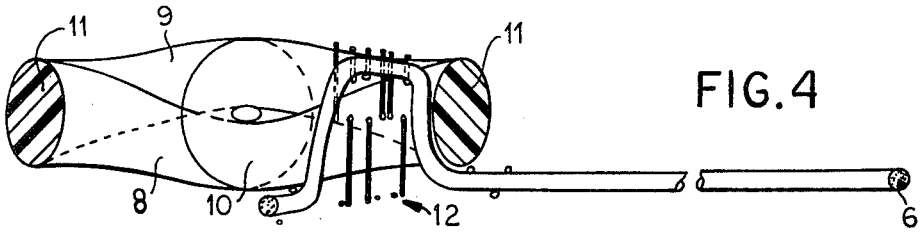
FIG. 4 is a sectional view in the direction of the arrow IV of FIG. 2.

As can be seen in FIGS. 1 and 6, a preferred embodiment of the invention has at least four connecting yarns 12 in offset relation, i.e. offset by at least one pick. Four of these yarns been shown in solid line, broken line, wiggly line and dot-dash line, respectively.

The connective yarns 12 each overshoot or engage over two successive coupling elements 7 and below the interstitial double weft 5 therebetween. In the embodiment shown the offset is one pick or step.

After engaging over the coupling members 7, each yarn 12 engages below the next coupling member 7 between the bottom shank 8 thereof and the double weft 4 therebelow. Thereafter the yarns 12 are secured in the stringer tape zone below the coupling element 7.

In FIG. 1, this attachment is effected by passing the connective warp below the next interstitial double weft 5 and below the next double weft 4 which lies beneath a successive coupling member before the pattern repeats. In the embodiment of FIG. 6, however, the attachment of the ground weave is effected by passing each connective warp beneath the double weft 5 forming the interstitial member and then between the lower shanks of the next coupling member and the double weft therebelow before the pattern is repeated.

As can also be seen from FIGS. 1 and 6, the interstitial double wefts 5 are drawn by at least one of the connective yarn as a yarn padding loop 14 of the ground weft as far as or above the level of the top shanks 9 of the coupling members.

Figure 5:
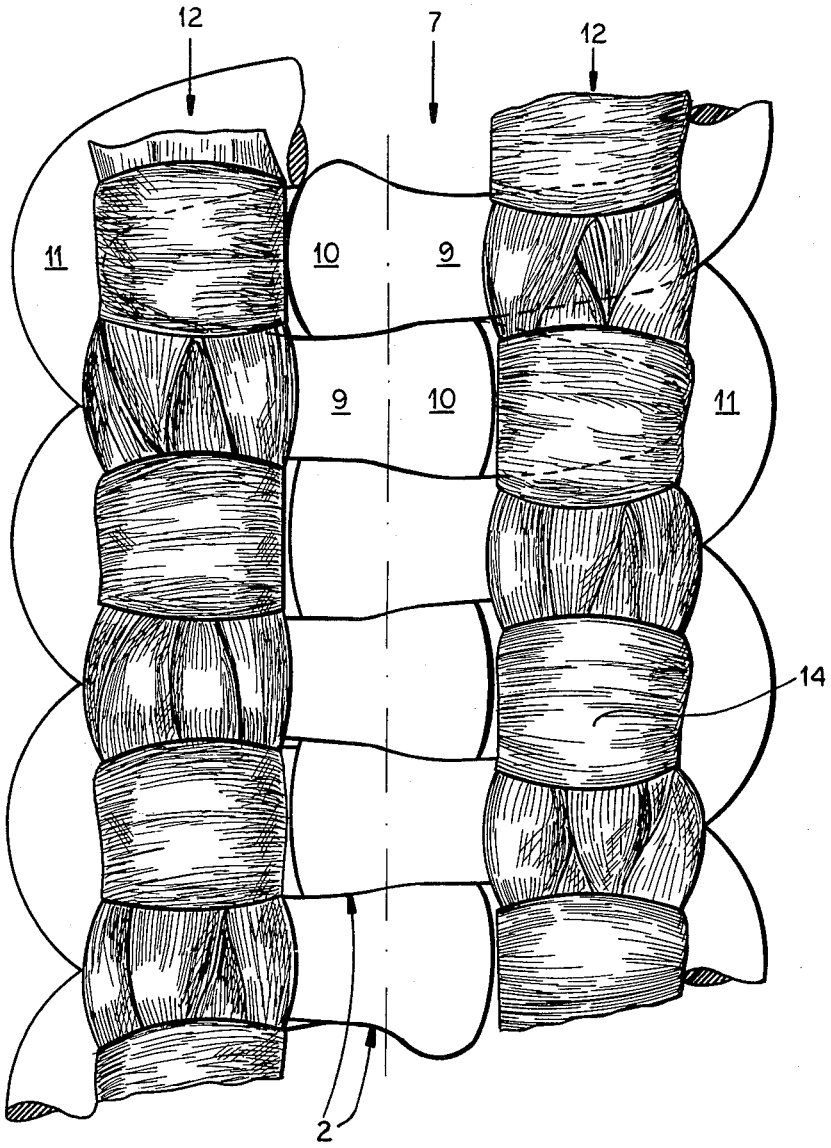
FIG. 5 is a plan view similar to FIG. 2 but showing the padding effect in less diagrammatic form.

The effect of this can be seen clearly from FIG. 5.

Figure 10:
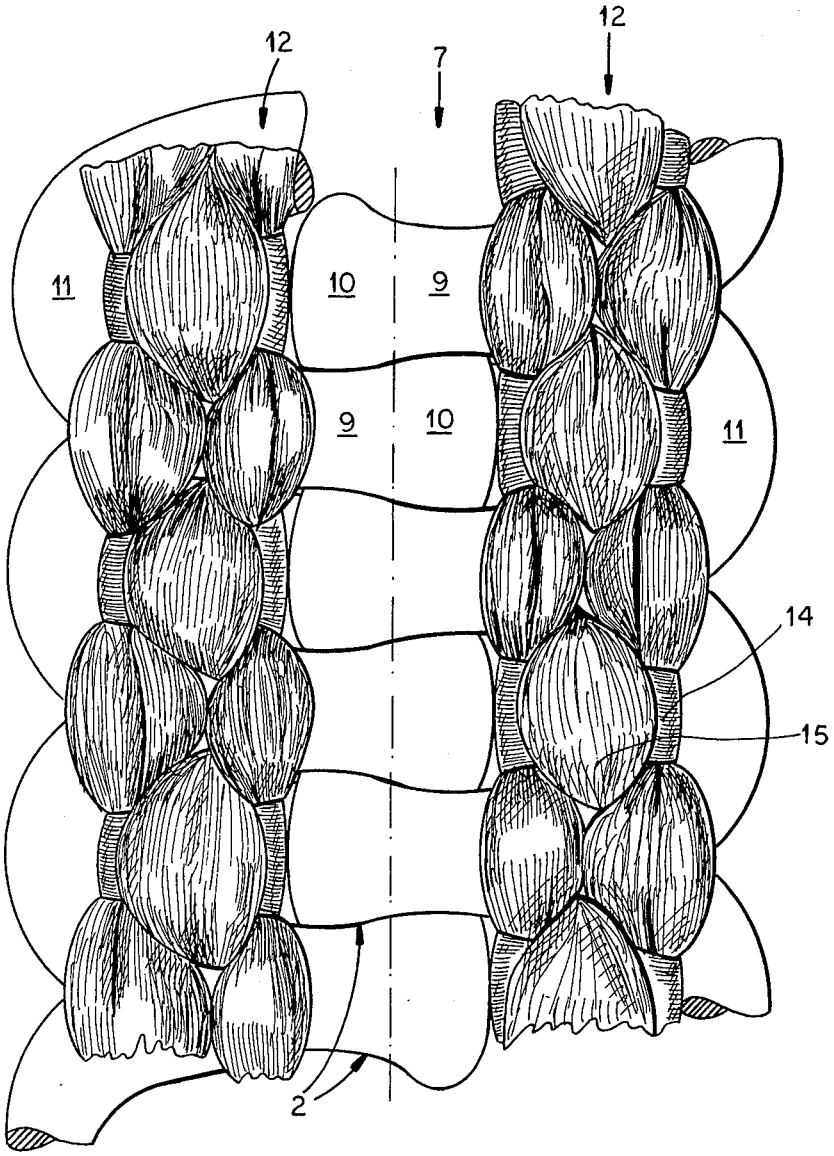
FIG. 10 is a plan view similar to FIG. 5 showing the padding arrangements more realistically.

FIGS. 5 and 10 are shown weft padding loops in the manner described although a modification of the FIG. 5 arrangement is represented in FIG. 10.

The dotted line shown in FIG. 6 indicates that one or more ground warp yarns 3 between adjacent coupling members can be drawn up to the top of the coupling elements, i.e. to the regions of the upper arms or shanks 9 of the coupling members as well above the median plane MP period.

FIGS. 5 and 10 show in somewhat more realistic form the loops 14 between the upper shanks 9 and in the form of pad-like elements, the loops 15 being those of the ground warp yarns.

As is also found from FIGS. 5 and 10 when two coupling elements of the stringer halves of a given slide fastener are interdigitated or interlocked, the padding loops 14 and/or 15 fill the interval between shanks 9 of the adjacent coupling members and the coupling head 10 of the opposing coupling element received therebetween so as to preload the shanks of various coupling members against one another.

We claim:

1. In a slide fastener having a stringer half formed with a woven ground-weave tape and a continuous monofilament coupling element woven into said tape during the weaving thereof and wherein said tape has a ground weave comprising ground warp yarns forming warp pockets receiving ground double wefts reaching to a longitudinal edge of the tape and formed by a continuous ground weft yarn, said coupling element comprising a multiplicity of coupling members spaced along apart along said edge with each coupling member having a coupling head projecting beyond said edge and a pair of shanks having superposed projections in a slide fastener plane overlying a portion of said tape adjacent said edge with connecting parts bridging the shanks of successive coupling members, the improvement wherein in combination:

said coupling element is secured to said tape on said portion by a plurality of connecting warp yarns;

the shanks of each coupling member form a double weft inner woven with said connecting warp yarns;

respective double wefts underlie each coupling member while interstitial ground double wefts lie between the coupling members;

said connecting warp yarns are offset longitudinally from one another with a stagger of at least one pick;

each of said connecting warp yarns overshoots two successive coupling members and passes below the interstitial double weft therebetween, and then engages below the next coupling member between the bottom shank thereof and the double wefts therebelow, and is then secured in the tape portion below the coupling element in a repeating pattern; and the interstitial double wefts disposed between successive coupling members are drawn by at least one of the connecting warp yarns as a ground weft padding loop away from the ground weave at least past the median plane of the coupling to the upper level of such members so that each padding loop substantially fills the space between the pair of respective coupling members and from the connecting parts thereof to a head of another coupling member receivable between the coupling members of said pair.

2. The improvement defined in claim 1 wherein each interstitial double wefts between successive coupling members is drawn by at least one of the connecting warp yarns to the level of the upper shanks of the coupling members.

3. The improvement defined in claim 1 wherein the interstitial weft between coupling members are drawn beyond the level of upper shanks of the coupling members away from the ground weave.

4. The improvement defined in claim 1, claim 2 or claim 3 wherein at least one ground warp yarn between adjacent coupling members is drawn as a ground warp yarn padding loop at least up to the level of upper shanks of the coupling members.

5. The improvement defined in claim 1, claim 2 or claim 3 wherein the connecting warp yarns are secured to said tape portion by passing below the next interstitial double weft and below a following double weft lying beneath the next coupling member in said pattern.

6. The improvement defined in claim 1, claim 2 or claim 3 wherein the connecting warp yarns are secured to said tape portion by passing below the next interstitial double weft and then between the bottom shank of the next coupling member and the double wefts underlying same in said pattern.

7. The improvement defined in claim 1, claim 2 or claim 3 wherein, upon interdigitation of the coupling members with coupling members of a mating slide fastener half, said padding loops fill the space between a pair of coupling members of one half and a coupling member of the other half received therebetween.

8. In a slide fastener having a stringer half formed with a woven ground-weave tape and a continuous monofilament coupling element woven into said tape during the weaving thereof and wherein said tape has a ground weave comprising ground warp yarns forming warp pockets receiving ground double wefts reaching to a longitudinal edge of the tape and formed by a continuous ground weft yarn, said coupling element comprising a multiplicity of coupling members spaced apart along said edge with each coupling member having a coupling head projecting beyond said edge and a pair of shanks having superposed projections in a slide fastener plane overlying a portion of said tape adjacent said edge with connecting parts bridging the shanks of successive coupling members, the improvement wherein in combination:

said coupling element is secured to said tape on said portion by a plurality of connecting warp yarns;

the shanks of each coupling member form a double weft inner woven with said connecting warp yarns;

respective double wefts underlie each coupling member while interstitial ground double wefts lie between the coupling members;

said connecting warp yarns are offset longitudinally from one another with a stagger of at least one pick;

each of said connecting warp yarns overshoots some of said coupling members, passes below the interstitial double weft between overshot coupling members, and then engages below subsequent coupling members between the bottom shank thereof and the double wefts therebelow, and is then secured in the tape portion below the coupling element in a repeating pattern; and the interstital double wefts disposed between successive coupling members are drawn by at least one of the connecting warp yarns as a ground weft padding loop away from the ground weave at least past the median plane of the coupling to the upper level of said members so that each padding loop substantially fills the space between the pair of respective coupling members and from the connecting parts thereof to a head of another coupling member receivable between the coupling members of said pair.

* * * * *